US010868350B2

(12) United States Patent
Oppenlaender et al.

(10) Patent No.: US 10,868,350 B2
(45) **Date of Patent: *Dec. 15, 2020**

(54) PHASE-CONTROLLED ANTENNA ELEMENT

(71) Applicant: Lisa Draexlmaier GmbH, Vilsbiburg (DE)

(72) Inventors: Joerg Oppenlaender, Kirchentellinsfurt (DE); Alexander Moessinger, Tuebingen (DE)

(73) Assignee: Lisa Draezlmaier GmbH, Vilsbiburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/316,077

(22) PCT Filed: Jun. 27, 2017

(86) PCT No.: PCT/EP2017/065881
§ 371 (c)(1),
(2) Date: Jan. 8, 2019

(87) PCT Pub. No.: WO2018/007209
PCT Pub. Date: Jan. 11, 2018

(65) Prior Publication Data

US 2020/0119422 A1 Apr. 16, 2020

(30) Foreign Application Priority Data

Jul. 8, 2016 (DE) ..... 10 2016 112 582

(51) Int. Cl.
*H01P 1/18* (2006.01)
*H01Q 1/42* (2006.01)
(Continued)

(52) U.S. Cl.
CPC ..... *H01P 1/182* (2013.01); *H01Q 1/425* (2013.01); *H01Q 3/32* (2013.01);
(Continued)

(58) Field of Classification Search
CPC .... H01P 1/182; H01Q 21/064; H01Q 15/244; H01Q 21/0075; H01Q 13/28;
(Continued)

(56) References Cited

U.S. PATENT DOCUMENTS 2,716,221 A 8/1955 Allen
5,283,590 A * 2/1994 Wong ..... H01Q 3/44 343/754

(Continued)

FOREIGN PATENT DOCUMENTS

CN 103107386 A 5/2013
DE 9200386 U1 4/1992

(Continued)

OTHER PUBLICATIONS

International Search Report for corresponding International Application No. PCT/EP2017/065881 dated Sep. 21, 2017 (22 pages).
Office Action of corresponding German Patent Application No. 10 2016 112 582.2 dated Dec. 12, 2016 (8 pages).

*Primary Examiner* — Robert J Pascal
*Assistant Examiner* — Kimberly E Glenn
(74) *Attorney, Agent, or Firm* — Jacob Eisenberg

(57) ABSTRACT

A phase-controlled antenna element includes a waveguide emitter with signal output or signal injection, into which a rotatable phase control element is introduced, and a drive unit. The phase control element comprises in this case a holder, at least two polarizers which are fastened to the holder, and a connecting element. Each of the at least two polarizers can convert a circularly polarized signal into a linearly polarized signal. The phase control element is rotatably fitted in the waveguide emitter and is connected to the drive unit with the aid of the connecting element in such a manner that the drive unit can rotate the phase control element about the axis of the waveguide emitter.

19 Claims, 8 Drawing Sheets

(51) Int. Cl.

| | |
|---|---|
| ***H01Q 3/32*** | (2006.01) |
| ***H01Q 13/02*** | (2006.01) |
| ***H01Q 13/28*** | (2006.01) |
| ***H01Q 15/24*** | (2006.01) |
| ***H01Q 21/00*** | (2006.01) |
| ***H01Q 21/06*** | (2006.01) |

(52) U.S. Cl.
CPC ..... *H01Q 13/0241* (2013.01); *H01Q 13/0258* (2013.01); *H01Q 13/28* (2013.01); *H01Q 15/244* (2013.01); *H01Q 21/0075* (2013.01); *H01Q 21/064* (2013.01)

(58) Field of Classification Search
CPC .. H01Q 13/0258; H01Q 13/0241; H01Q 3/32; H01Q 1/425
See application file for complete search history.

(56) References Cited

U.S. PATENT DOCUMENTS

| | | | | |
|---|---|---|---|---|
| 6,081,234 | A * | 6/2000 | Huang | H01Q 3/14 343/700 MS |
| 6,822,615 | B2 | 11/2004 | Quan et al. | |
| 2010/0109960 | A1 | 5/2010 | Guler et al. | |

FOREIGN PATENT DOCUMENTS

| | | | |
|---|---|---|---|
| DE | 102007003388 | A1 | 8/2007 |
| EP | 2955788 | A1 | 12/2015 |
| JP | 55-102901 | | 8/1980 |
| WO | WO 02/084797 | A1 | 10/2002 |

* cited by examiner

PHASE-CONTROLLED ANTENNA ELEMENT

CROSS REFERENCE TO RELATED APPLICATIONS

This application is a national phase application of International Application No. PCT/EP2017/065881, filed Jun. 27, 2017, and claims the priority of German Application No. 10 2016 112 582.2, filed Jul. 8, 2016, the content of both of which is incorporated herein by reference.

FIELD

The present disclosure relates to a phase-controlled antenna element for phase-controlled antenna arrays, in particular for the GHz frequency range.

BACKGROUND

A phase-controlled antenna element is intended to arbitrarily adjust, control and monitor the phase position of an electromagnetic wave emitted or received by the antenna element.

It is known that with the aid of variable, controllable phase control elements ("phase shifters"), the antenna orientation diagram of stationary antenna groups can be spatially varied. For instance, the primary beam can be pivoted in various directions. The phase control elements, in so doing, vary the relative phase position of the signals that are received or sent by various individual members of the antenna arrays. If the relative phase position of the signals of the individual antennas is adjusted accordingly with the aid of the phase control elements, then the primary beam ("main beam") of the antenna diagram of the antenna array points in the desired direction.

The currently known phase actuators are mostly constructed of nonlinear solid bodies ("solid state phase shifters"), mostly ferrites, microswitches (MEMS technology, binary switches), or liquid crystals. All of these technologies, however, have the disadvantage that on the one hand they often lead to considerable signal loss, since some of the high-frequency power is dissipated in the phase actuators. Particularly in applications in the GHz range, the antenna efficiency of the antenna arrays drops sharply as a result.

Conventional phase actuators must furthermore always be accommodated in the feed networks of the antenna arrays. This leads to an unwanted enlargement in the dimensions of the feed networks and thus in the antenna arrays themselves. Furthermore, the antenna arrays are typically very heavy.

Phase-controlled antenna arrays in which conventional phase control elements are used are very expensive. Particularly for civilian applications above 10 GHz, this prevents their being used.

A further problem is the precise control of the antenna diagram of the antenna arrays. Such control is possible only when the amplitude relations and the phase positions of all the signals which are sent or received by the antenna elements of the antenna array are precisely known at all times (that is, for every situation).

None of the currently known technologies for phase control elements, however, allow the reliable, instantaneous determination of the phase position of the signal downstream of the phase control element. That would necessitate being able to determine the status of the phase control element reliably at all times. However, in neither solid-state nor MEMS nor liquid crystal phase shifters is this practically possible.

Solid-state phase shifters furthermore typically include nonlinear components, which makes it very difficult or even impossible to determine the amplitude relations. Moreover, the damping values and wave impedance of such phase shifters are typically dependent on the value of the phase rotation.

Phase shifters which are based on microswitches (MEMS technology) typically function in binary fashion. In binary phase shifters, in principle the phase position of the individual signals can be adjusted granularly only in certain steps. Thus in principle, a highly precise orientation of the antenna diagram is not possible.

In liquid crystal phase shifters, furthermore, the problem exists of the dependency of the characteristic curves on ambient factors. The characteristic curves of the components exhibit a major temperature and pressure dependency, and at lower temperatures, for example, they freeze.

From U.S. Pat. No. 6,822,615 B2, a phase-controlled antenna array is known which includes electronically controllable lenses and MEMS phase shifters. DE 9200386 U1 shows an antenna structure on the Yagi principle, in which parasitic elements comprising circular, centrally perforated discs between shell-shaped spacers are slipped onto a supporting tube.

SUMMARY

In view of the above limitations of the related art, an object of certain embodiments of the present disclosure may therefore be to make a phase-controlled antenna element, in particular for phase-controlled antenna arrays and for the GHz frequency range, available which 1. allows the exact adjustment and control of the phase position of signals, which are sent or received by the antenna element;
2. at any time allows the instantaneous determination of the phase position of the received or sent signal;
3. exhibits no dependency of the wave impedance on the phase position;
4. induces no or only very slight losses;
5. integrates phase control and antenna function in a single component; and
6. can be implemented economically.

In some embodiments of the disclosure, the above object may be attained by a phase-controlled antenna element according to a first aspect. Advantageous refinements of embodiments of the disclosure can be learned from this and other aspects as discussed in the specification, and the drawings. Objects and advantages of the disclosed embodiments may be realized and attained by the elements and combinations set forth in the claims. However, embodiments of the present disclosure are not necessarily required to achieve such exemplary objects and advantages, and some embodiments may not achieve any of the stated objects and advantages.

A phase-controlled antenna element of a first aspect may include an antenna emitter, such as a waveguide emitter. The emitter may be provided with a coupler, such as a signal output injection and input injection, into which a rotatable phase control element is introduced, and a drive unit.

Further advantages and features of the present disclosure will become clear from the following description of exemplary embodiments. The features described therein and above can be implemented on their own or in combination, provided the features do not contradict one another. It is to be understood that both the foregoing general description and the following detailed description are exemplary and explanatory only and are not restrictive of the subject matter as claimed.

BRIEF DESCRIPTION OF THE DRAWINGS

The above and other aspects of the present disclosure will become more apparent by describing exemplary embodiments in detail below with reference to the accompanying drawings, in which.

DETAILED DESCRIPTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C," then, unless specifically stated otherwise or infeasible, the component may include A, or B, or C, or A and B, or A and C, or B and C, or A and B and C. Expressions such as "at least one of" do not necessarily modify an entirety of a following list and do not necessarily modify each member of the list, such that "at least one of A, B, and C" should be understood as including only one of A, only one of B, only one of C, or any combination of A, B, and C.

Figure 1:
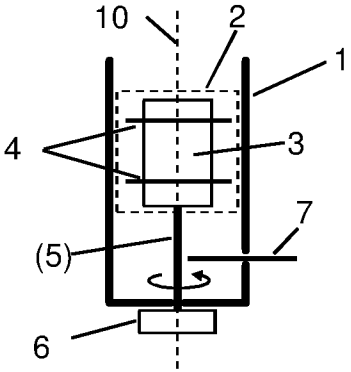
FIG. 1 illustrates a waveguide emitter having a phase control element, consistent with embodiments of the present disclosure.

An exemplary arrangement of a phase-controlled antenna element for antenna arrays is shown in FIG. 1. A phase control element 2 includes a holder 3, at least two polarizers 4 that are secured to the holder 3, and a connecting element 5. Holder 3 may include a mounting.

Each of the at least two polarizers 4 may be configured to convert between linearly polarized and circularly polarized signals. For example, each of the at least two polarizers 4 can convert a circularly polarized signal into a linearly polarized signal. A drive unit 6 may be configured to rotate the phase control element 2 about an axis of the waveguide emitter 1. For example, the phase control element 2 is mounted rotatably in the waveguide emitter 1 and is connected with the aid of the connecting element 5 to the drive unit 6 in such a way that the drive unit 6 can rotate the phase control element 2 about the axis 10 of the waveguide emitter 1, as is shown in sketched fashion in FIG. 1.

Figure 2:
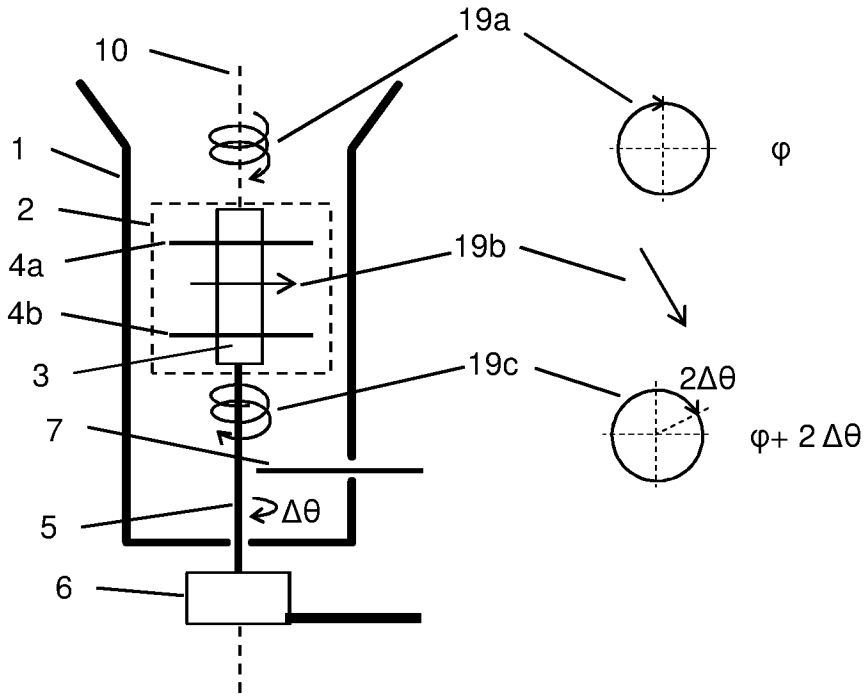
FIG. 2 shows a principle mode of operation of a phase control element, consistent with embodiments of the present disclosure.

The principal mode of operation of an embodiment of the present disclosure is shown in FIG. 2. A wave 19*a* with circular polarization and a phase position $\varphi$ entering the waveguide emitter 1 is transformed by the first polarizer 4*a* into a wave with linear polarization 19*b*. This wave with linear polarization is reconverted by the second polarizer 4*b* into a wave with circular polarization 9*c*.

If the phase control element 2 is now rotated, with the aid of the drive unit 6 and the connecting element 5, by an angle $\Delta\theta$ in the waveguide emitter 1, then the polarization vector of the linear wave 19*b*, between the two polarizers 4*a* and 4*b*, rotates as well in a plane perpendicular to the axis 10 (e.g., in the propagation direction of the electromagnetic wave). Since the polarizer 4*a* also rotates as well, the circular wave 19*c*, which is generated by the second polarizer 4*b*, now has a phase position of $\varphi+2\ \Delta\theta$. The circular wave 19*c* with a phase position $\varphi+2\ \Delta\theta$ can thereupon be output-coupled from the waveguide emitter 1 with the aid of a coupler 7. The coupler 7 may include an injector and may be configured for signal output or signal input.

Because of the construction of the phase control system of the antenna element, the dependency of the phase angle difference between the outgoing 19*c* and incoming 19*a* circular wave on the rotation of the phase control element 2 is strictly linear, steady, and strictly $2\pi$ periodic. Furthermore, any arbitrary phase rotation or phase shift can be adjusted continuously by the drive unit 6.

Since the phase control element 2, considered electrodynamically, may be a purely passive component, which includes no nonlinear components whatever, its function is entirely reciprocal. That is, a wave which runs from bottom to top through the phase control element 2 is rotated in its phase in the same way as a wave that runs from top to bottom through the phase control element 2.

The phase position of a signal sent or received by the waveguide emitter 1 can thus be adjusted arbitrarily. The simultaneous sending and receiving mode is also possible.

The wave impedance of the waveguide emitter 1 may also, because of construction, be entirely independent of the relative phase position of the incoming and outgoing wave.

In antenna elements which are controlled in their phase position with the aid of nonlinear phase shifters such as semiconductor phase shifters or liquid crystal phase shifters, this is typically not the case. There, the wave impedance is dependent on the relative phase position, which makes these components difficult to control.

The phase control furthermore operates practically without loss, since given a suitable design, the losses induced by the polarizers 4*a* and 4*b* and the dielectric holder 3 are very slight.

At frequencies of 20 GHz, for example, the entire losses amount to less than 0.2 dB, which is equivalent to an efficiency of more than 95%. Conventional phase shifters, conversely, typically already have losses of several dB at these frequencies.

With respect to its high-frequency properties, a phase-controlled antenna element of some embodiments of the disclosure is therefore hardly distinguishable from a corresponding antenna element without phase control, of the kind already used for instance in antenna fields.

Thus it is known that dielectrically filled horn emitters, for instance, in particular at frequencies greater than 20 GHz, are used in antenna fields on account of their high antenna efficiency. If such antenna fields with phase-controlled antenna elements according to some embodiments of the disclosure are implemented, then the RF properties, in particular antenna gain and antenna efficiency, of the antenna fields advantageously change only insignificantly despite the additional phase control.

A further advantage of the device of some embodiments of the disclosure is therefore that the phase control function and the antenna function are integrated into a single component and nevertheless are entirely independent of one another.

The waveguide emitter 1 is advantageously designed such that it contains at least one cylindrical waveguide piece (e.g., at least a portion being cylindrical, which may include a part having a circular cross section). Thus it is securely ensured that in its interior, a cylindrically symmetrical electromagnetic oscillation mode of circular polarization can develop, which can be transformed by the polarizers 4 into a linear polarization mode.

Both the waveguide closure of the waveguide emitter and its opening (aperture), conversely, need not necessarily have a circular cross section. Depending on the type of coupler 7, the waveguide emitter closure can for instance be embodied conically or in stepped fashion on one side. The aperture of the waveguide emitter, in use in two-dimensional antenna fields, can for instance also be signed as conical, square or rectangular.

Since cylindrically symmetrical modes can also propagate in waveguides with non-circular cross sections, such as elliptical or polygonal cross sections, however, some embodiments may provide still other structural forms of the waveguide emitter.

In round waveguides, it is known that cylindrical modes generically occur. It can therefore be advantageous to embody the waveguide emitter 1 as a round waveguide, if the coupler 7 can be designed accordingly.

To improve the antenna gain of the phase-controlled antenna element, it can furthermore be advantageous to design the waveguide emitter 1 as a horn emitter.

Furthermore, the dimensional design of the waveguide emitter 1 is done for a defined operating frequency band in accordance with known methods of antenna technology.

An axis of rotation 10 for the phase control element 2 is preferably located in the axis of symmetry of the cylindrical waveguide piece that the waveguide emitter 1 advantageously includes. Thus it can be ensured that the mode conversion by the polarizers 4 takes place in an optimal way.

The at least two polarizers 4*a* and 4*b* are preferably mounted perpendicularly to the axis of rotation 10 and parallel to one another in the holder 3. The linear mode between the polarizers can then develop unimpeded.

If the drive unit 6 is equipped with an angular position transmitter, or if it itself already transmits an angular position (as is the case in some piezoelectromotors, for instance), then the phase position of the wave 19*a* emitted or received by the waveguide emitter 1 can be determined exactly at any time instantaneously, or in other words immediately, without further calculation.

Because of the simple construction of the phase control element 2 and because of the fact that only very simply constructed drives may be required, the phase-controlled antenna element can be implemented very economically. Even reproducing the phase-controlled antenna elements in great quantities, for instance for use in larger antenna arrays, is readily possible.

As drive units 6, there may be provided electromotors, which may include microelectromotors or piezoelectromotors, for example. In some embodiments, economical electromotors or microelectromotors, for example, and also piezoelectromotors, or simple actuators, which are constructed from electroactive materials, can be considered.

The connecting element 5 is preferably embodied as a shaft and advantageously consists of a nonmetallic, dielectric material, such as plastic. This has the advantage that cylindrical hollow-body modes are interfered with not at all, or only very slightly, if the shaft is mounted symmetrically in the waveguide emitter 1.

If coaxial modes are used for operating the waveguide emitter 1 however, then metal shafts can also be used. In such a case, some embodiments may provide the drive unit 6 mounted directly on the phase control element 2 in the waveguide emitter 1.

However, in some embodiments, the drive unit 6 may rotatethe phase control element 2 in contactless fashion, for instance via a rotating magnetic field. To that end, for instance via the closure of the waveguide emitter, a magnetic rotator can be mounted, which then cooperates with the rotating magnetic field as the connecting element 5, for instance if parts of the polarizer consist of magnetic materials.

The polarizers 4*a* and 4*b* can for instance include simple, plane meander polarizers, which are mounted on a conventional carrier material. These polarizers can be produced by known thin-film etching methods or by additive methods (e.g., "circuit printing").

Figure 3:
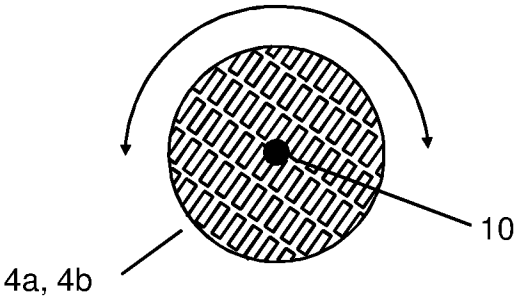
FIG. 3 illustrates a polarizer, consistent with embodiments of the present disclosure.

As shown in FIG. 3, the polarizers 4*a* and 4*b* preferably have a shape that is symmetrical to the axis 10, so that they can be accommodated easily in the cylindrically symmetrical waveguide piece of the waveguide emitter 1. For example, the carrier material of polarizers 4*a* and 4*b* may include a substrate that is rotationally symmetric about axis 10. The substrate may be circular.

The polarizer shown in FIG. 3 includes a meander polarizer. Advantageously, multi-layer meander polarizers, that is, structures oriented parallel to one another and separated from one another by only fractions of the wavelength of waves at the operating frequency, since those can have broad frequency bandwidths and thus enable broadband operation.

However, there are also many other possible embodiments of polarizers for electromagnetic waves that can transform a wave of circular polarization into a wave of linear polarization.

For instance, in some embodiments, the conversion of the signal polarization may be effected not by plane polarizers but rather by structures distributed spatially in the holder (such as septum polarizers). For the function of some embodiments of the present disclosure, the only critical aspect may be that these structures can transform a wave with circular polarization, entering the waveguide emitter 1, first into a wave with linear polarization and then finally back into a wave with circular polarization.

For the holder 3, low-density closed-cell foams, which are known to have very low RF losses, can also be used, but so can plastic materials such as polytetrafluoroethylene (Teflon) or polyim ides. Because of the slight size of the phase control element in the vicinity of a wavelength, at 10 GHz frequencies, the RF losses, given equivalent impedance adaptation to the corresponding electromagnetic mode in the waveguide emitter 1, also remain very low here.

Since in electrodynamic terms the dimensional design of the phase control element 3 at a defined operating frequency is effected in a similar way to the dimensional design of the waveguide emitter 1 at a defined operating frequency, the phase control element 2 can typically be mounted readily in the interior of the waveguide emitter 1.

Thus in accordance with the known design specifications for a waveguide emitter, its minimal diameter is typically in the range of one wavelength of the operating frequency. The length of the waveguide emitter in the direction of the incident waves is typically a few wavelengths of the operating frequency.

Since the polarizers 4*a* and 4*b* and their spacing from one another also, in accordance with the wavelength of the operating frequency, are designed in accordance with the known methods of impedance adaptation, the phase control element may be configured so that its dimensions are always within the range of the dimensions of the waveguide emitter 1.

At a frequency of 20 GHz, for example, the dimensions of the phase control element 2 are typically in the range of less than one wavelength, that is, about 1 cm×1 cm. If the holder 3 is designed as a dielectric packing material and the dielectric constant is selected as correspondingly large, then a great many small forms can also be attained. The ohmic losses may rise slightly, but are still only in the range of a few percent of what might they would be otherwise.

In some embodiments, even if the dimension of the waveguide emitter 1 is selected as very small, the phase control element 2 may, by suitable choice of the dielectric constant for the material of the holder 3, be made so small that there is space for it in the waveguide emitter 1.

Figure 4:
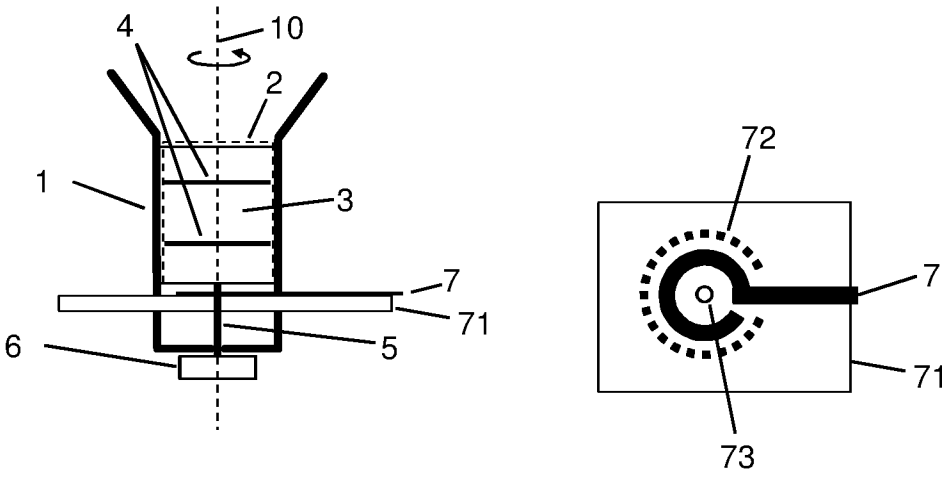
FIG. 4 shows a phase-controlled antenna element using microstrip (MS) technology, consistent with embodiments of the present disclosure.

An embodiment of a phase-controlled antenna element is shown schematically in FIG. 4.

The waveguide emitter 1 is configured as a cylindrical horn emitter, and the coupler 7 is embodied by microstrip technology on an RF substrate 71.

The coupler 7 may include a microstrip line used for output and input injection of the circular mode that is designed here in loop-like form. This has the advantage that the cylindrically symmetrical waveguide mode in the waveguide emitter 1 can be excited or output-coupled directly and practically without losses.

The waveguide emitter 1 is at least partially cut out at the position of the coupler 7 in such a way that the coupler 7 with its substrate 71 can be introduced and oriented in the waveguide emitter 1.

So that no interference of the RF currents that flow at the inner walls of the waveguide emitter 1 will occur, conductive throughplugs ("vias") 72 are provided, which establish a continuous electrical contact (so-called "via fence") between the upper and lower parts of the waveguide emitter 1 at the location where the coupler 7 is introduced.

Furthermore, in the substrate 71 a recess 73 is provided, through which the connecting element 5 that establishes the connection between the drive unit 6 and the phase control element 2 can be passed.

In the exemplary embodiment of FIG. 4, the holder 3 of the polarizers 4 is moreover embodied as a dielectric packing material 9, which completely fills the cross section of the waveguide emitter 1.

Such embodiments of the holder can be advantageous, since thus the impedance adaptation of the modes in the waveguide emitter 1 can be made easier, and unwanted modes can be suppressed.

Materials that can be considered for the dielectric packing material are in particular plastic materials with low surface energy, such as polytetrafluoroethylene (Teflon) or polyimides, which upon a rotation in the waveguide emitter 1 generate only very slight to negligible friction.

Figure 5:
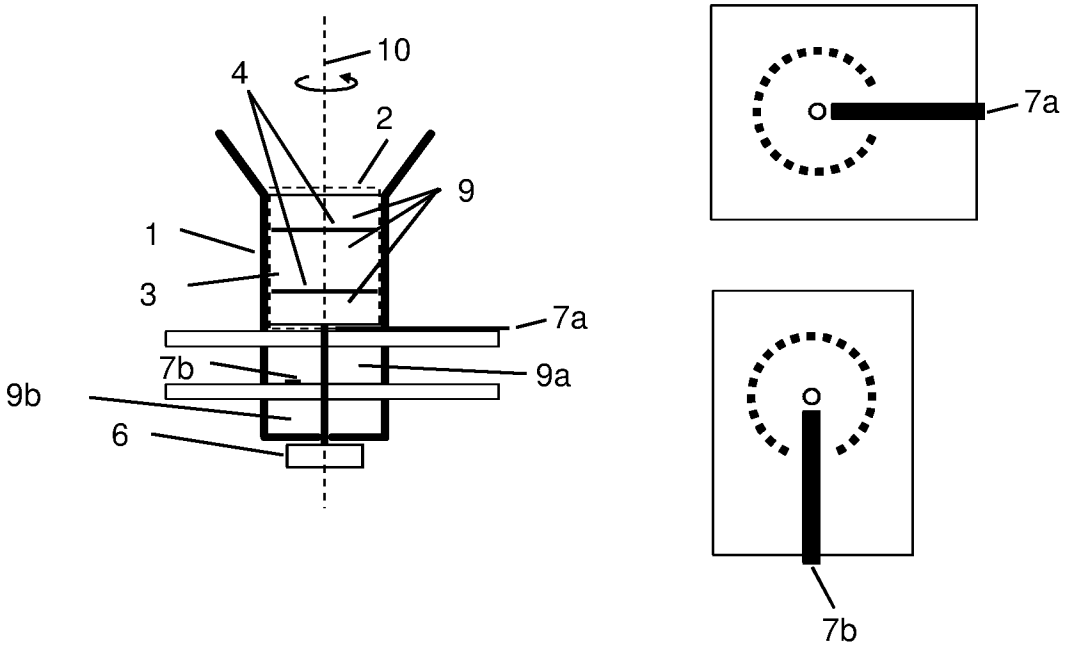
FIG. 5 shows a phase-controlled antenna element with dielectric packing material, consistent with embodiments of the present disclosure.

In the embodiment schematically shown in FIG. 5, the coupler 7 is embodied as split into two, in the form of two orthogonal, pin- or stylus-like microstrip lines 7*a* and 7*b*, which are located on two separate substrates lying one above the other.

Such embodiments can be advantageous if with the phase-controlled antenna element two signals of orthogonal polarization are to be simultaneously received or sent. Phase imbalances can also be compensated for, if the signals are processed in an orthogonal system.

In the exemplary embodiment of FIG. 5, further dielectric packing materials 9*a* and 9*b* are provided, which ensure that air volume remaining in the waveguide emitter 1 is completely filled with dielectric.

Typically, the packing materials 9*a* and 9*b* are mounted fixedly in the waveguide emitter 1 and do not rotate with the phase control element. To that end, they typically have a recess for the axis 10, analogous to the substrates of the microstrip lines 7*a* and 7*b*.

If the dielectric packing materials 9*a* and 9*b* consist of the same material as the dielectric packing materials of the holder 3, then the waveguide emitter 1 is filled homogeneously with dielectric, and the mode distribution in its interior is advantageously homogeneous.

Depending on the geometric form of the waveguide emitter (1), however, it can also be advantageous to select different dielectric constants for the various dielectric packing materials 9, 9*a*, and 9*b*. For instance, whenever the waveguide emitter 1 narrows toward the bottom, it can be advantageous to use a higher dielectric constant for the packing material 9*b*.

Figure 6:
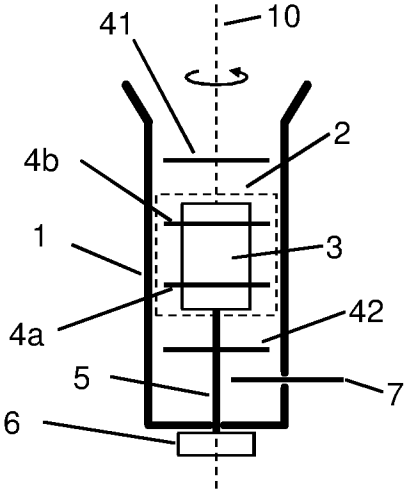
FIG. 6 shows a phase-controlled antenna element for linear modes, consistent with embodiments of the present disclosure.

A further embodiment of the disclosure related to receiving or sending signals of linear polarization directly by a phase-controlled antenna element is shown in FIG. 6.

In the embodiment, at least one further polarizer 41 is mounted in the waveguide emitter 1 upstream of the phase control element 2, the polarizer 41 configured to transform signals with linear polarization into signals with circular polarization, and at least one further polarizer 42 is mounted downstream of the phase control element 2 and upstream of the coupler 7, the polarizer 42 configured to transform signals of circular polarization into signals of linear polarization.

The phase control element 2 further includes the holder 3 and the polarizers 4*a* and 4*b* and has a drive unit 6, which is connected via the connecting element 5 to the phase control element 2 or the holder 3 in such a way that the phase control element 2 or the holder 3 can be rotated in the waveguide emitter 1 about the axis 10.

Because the first additional polarizer 41 converts an incoming signal with linear polarization into a signal with circular polarization, the phase control element 2 can readily perform its function according to some embodiments of the disclosure.

The second polarizer 42, which is mounted downstream of the phase control element 2 and upstream of the output injection 7, then transforms the signal of circular polarization, generated by the phase control element 2 and determined in its phase position, back again into a signal of linear polarization, which can be output-coupled directly from a coupler designed for linear modes.

The function of the arrangement is again entirely reciprocal. In the case of sending, by means of the coupler 7 a linear mode in the waveguide emitter 1 is excited, which is transformed by the second polarizer 42 into a circular mode. A phase position dependent on the angle of rotation of the phase control element 2 about the axis 10 is impressed on this circular mode by the phase control element 2. The circularly polarized signal with the adjusted phase position that is leaving the phase control element 2 is transformed by the first polarizer 41 into a signal with linear polarization and with the impressed phase position and is emitted by the waveguide emitter 1.

The arrangement shown in FIG. 6 furthermore functions for two simultaneously occurring orthogonal linear polarizations as well, if the coupler 7 is correspondingly designed for two orthogonal linear modes, for instance as shown in FIG. 5.

The simultaneous sending and receiving of signals of the same or different polarization is also possible.

Figure 7:
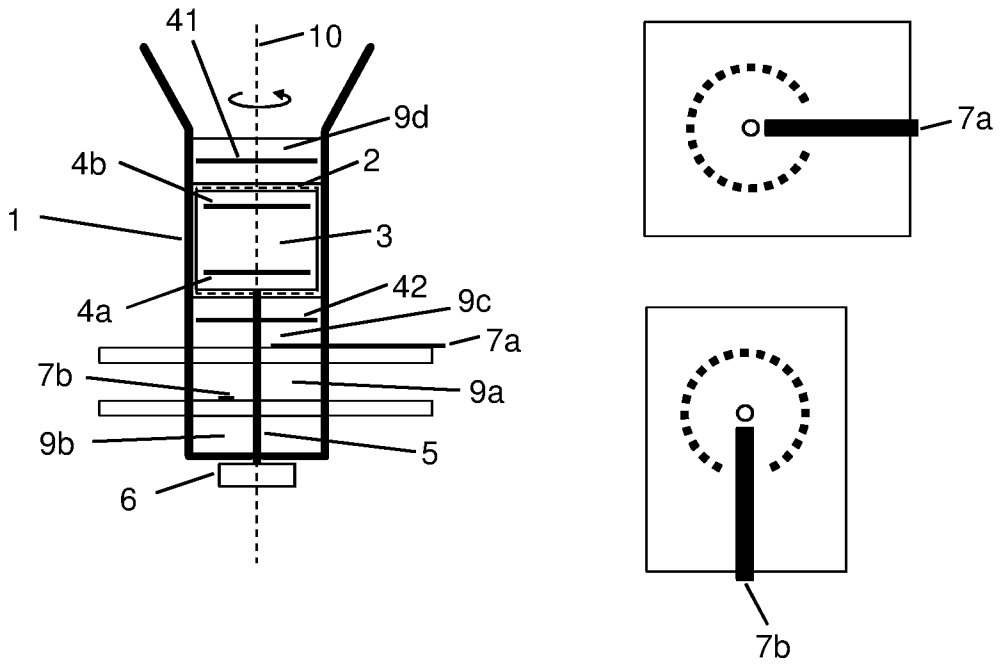
FIG. 7 shows a phase-controlled antenna element for linear modes using MS technology.

A further embodiment related to the embodiment shown in FIG. 6 is schematically shown in FIG. 7.

Analogously to the exemplary embodiment of FIG. 5, the coupler 7 is embodied as split in two in a form of pin- or stylus-like, orthogonal microstrip lines 7*a* and 7*b* on separate substrates.

The additional polarizers 41 and 42 are each embedded in a dielectric packing material 9*c* and 9*d*, respectively, and typically mounted fixedly in the waveguide emitter 1. The region between the output and input injections, which may be provided by microstrip lines 7*a* and 7*b*, is filled with a dielectric packing material 9*a*, and the waveguide closure below the microstrip line 7*b*, which may provide an output or input injection, is filled with a dielectric packing material 9*b*.

This construction has the advantage that the entire interior of the waveguide emitter 1 may be filled with a typically identical dielectric, and thus mode discontinuities may be avoided.

The second additional polarizer 42 and its dielectric packing material 9*c*, like the dielectric packing materials 9*a* and 9*b*, have a central recess for the connecting element 5 analogously to the substrates of the microstrip lines 7*a* and 7*b* (see FIG. 4, substrate 73), so that the connecting element 5 can be freely rotated.

The output and input injection 7*a* and 7*b*, respectively, can, for a corresponding application, also be designed in one piece for a linear mode (analogously to the exemplary embodiment of FIG. 4).

Furthermore, in some embodiments, the first additional polarizer 41 may be configured as rotatable and may be equipped with its own independent drive, so that the polarizer 41 can be rotated independently of the phase control element 2 in the waveguide emitter 1 about the axis 10. This may be useful to compensate for a polarization rotation of an incident wave.

Such an arrangement is especially advantageous whenever in mobile arrangements, on account of the motion of the carrier, a rotation of the polarization vector of the incident wave relative to the antenna array mounted fixedly on the carrier occurs.

Since such a polarization rotation is generally independent of the phase rotation which serves the purpose of the spatial orientation of the antenna beam, there may be a configuration where the rotation of the polarizer is capable of being done independently of the rotation of the phase control element 2.

Figure 8:
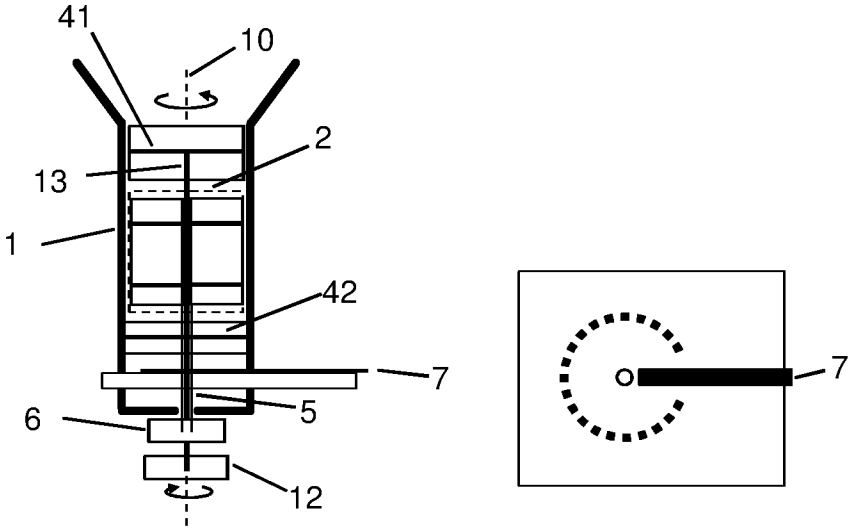
FIG. 8 shows a phase-controlled antenna element with additional rotatable polarizers, consistent with embodiments of the present disclosure.

A corresponding exemplary embodiment is schematically shown in FIG. 8.

The polarizer 41 is mounted rotatably in the waveguide emitter 1 and is connected with the aid of a connector 13 to its own drive 12, so that this drive 12 can rotate the polarizer 41 about the axis 10. Connect 13 may include a shaft.

The independent rotation of the polarizer 41 from the rotation of the phase control element 2 is achieved in the exemplary embodiment of FIG. 8 such that the connecting element 5, which connects the phase control element 2 with its drive 6, is embodied as a hollow shaft. The connector 13, which connects the polarizer 41 to its drive 12, is located in this hollow shaft.

Since the polarization plane of a wave with linear polarization is defined only in an angular range of 180°, an angular range from −90° to +90°, or in other words a semicircular rotation, may be sufficient for the rotation of the polarizer 41.

The second additional polarizer 42 is fixedly mounted in the waveguide emitter 1, since its orientation determines the orientation of the linear mode that is output- or input-coupled by the coupler 7. The fixed orientation of the polarizer 42 is therefore oriented to the position of the output or input injection 7.

The coupling 7 in the exemplary embodiment of FIG. 8 is embodied in one piece as a stylus-like microstrip line.

This form of embodiment is advantageous if a linear mode is to be output- or input-coupled from the waveguide emitter 1.

Conversely, if two orthogonal linear modes are output- or input-coupled, then the two-part output or input injection 7*a* and 7*b* shown in FIG. 7 is advantageous, which can be implemented in the same way in the exemplary embodiment of FIG. 8 as in the exemplary embodiment of FIG. 7.

If the coupler 7 is embodied in two parts, then the second additional polarizer 42 may be omitted, since the circularly polarized signal generated by the phase control element 2 in principle contains all the information of the incident wave. For recombination of the original signal, a 90° hybrid coupler can for instance then be used, into which the signal, split into the microstrip lines 7*a* and 7*b*, is fed.

Having described aspects of the present disclosure in detail, it will be apparent that further modifications and variations are possible without departing from the scope of the present disclosure. All matter contained in the above description and shown in the accompanying drawings shall be interpreted as illustrative and not in a limiting sense.

The invention claimed is:

1. A phase-controlled antenna element for antenna arrays, comprising: a waveguide emitter, a rotatable phase control element located in the waveguide emitter, the phase control element including:

at least two polarizers configured to convert between a circularly polarized signal and a linearly polarized signal, a holder connected to the polarizers, the holding comprising closed-cell foam, and a connecting element, a drive unit connected via the connecting element to the phase control element, the drive unit configured to rotate the phase control element about an axis of the waveguide emitter, a coupler coupled to the waveguide emitter.

2. The phase-controlled antenna element of claim 1, wherein the waveguide emitter comprises a cylindrical waveguide section.

3. The phase-controlled antenna element of claim 2, wherein the waveguide emitter comprises a round waveguide.

4. The phase-controlled antenna element of claim 1, wherein the waveguide emitter comprises a horn emitter.

5. The phase-controlled antenna element of claim 1, wherein the at least two polarizers are mounted perpendicular to the axis of the waveguide emitter and parallel to one another in the holder.

6. The phase-controlled antenna element of claim 1, wherein the at least two polarizers comprise a meander polarizer.

7. The phase-controlled antenna element of claim 6, wherein the at least two polarizers comprise plane multi-layer meander polarizers.

8. The phase-controlled antenna element of claim 1, wherein the at least two polarizers have a shape that is symmetrical to the axis.

9. The phase-controlled antenna element of claim 1, wherein the connecting element comprises a shaft that connects the phase control element to the drive unit.

10. The phase-controlled antenna element of claim 1, wherein the phase control element has an axially symmetrical shape.

11. The phase-controlled antenna element of claim 1, wherein the drive unit comprises an actuator including electroactive materials.

12. The phase-controlled antenna element of claim 1, wherein the connecting element or the drive unit is provided with an angular position transmitter.

13. The phase-controlled antenna element of claim 1, wherein coupler comprises a loop-like or stylus-like metal structure.

14. The phase-controlled antenna element of claim 1, wherein the coupler comprises microstrip lines.

15. The phase-controlled antenna element of claim 1, wherein the coupler comprises two parts and is configured to input- or output-couple two orthogonal modes of the waveguide emitter separately.

16. The phase-controlled antenna element of claim 1, wherein the waveguide emitter comprises dielectric packing material that at least partially fills the waveguide emitter.

17. The phase-controlled antenna element of claim 1, wherein between an aperture of the waveguide emitter and the phase control element, at least one additional polarizer is mounted in the waveguide emitter, the at least one additional polarizer configured to convert between a signal with linear polarization and a signal with circular polarization.

18. The phase-controlled antenna element of claim 17, wherein between the phase control element and the coupler, at least one further additional polarizer is mounted in the waveguide emitter, the at least one further additional polarizer configured to convert between a signal with linear polarization and a signal with circular polarization.

19. The phase-controlled antenna element of claim 17, wherein the at least one additional polarizer mounted between the aperture of the waveguide emitter and the phase control element is mounted rotatably in the waveguide emitter and has an additional drive and an additional connector, so that the additional drive, with the aid of the additional connector, is configured to rotate the at least one additional polarizer independently of the phase control element.

* * * * *